United States Patent [19]

Reich et al.

[11] 3,967,262

[45] June 29, 1976

[54] LINE INTEGRATED COMBINATION MAGNETIC AND STRAIN LINE SENSOR

[75] Inventors: Herbert A. Reich, Alexandria; Jack K. Maier, Fairfax Station, both of Va.

[73] Assignee: The United States of America as represented by the Secretary of the Army, Washington, D.C.

[22] Filed: Apr. 30, 1975

[21] Appl. No.: 573,286

[52] U.S. Cl. ..... 340/258 R; 324/34 MA; 324/34 PS; 340/38 R; 340/272

[51] Int. Cl.[2] ..... G08B 13/22; G08B 13/02

[58] Field of Search ..... 340/258 R, 38 L, 38 R, 340/258 C, 272; 324/34 PS, 34 MA; 73/89

[56] References Cited

UNITED STATES PATENTS

| | | | |
|---|---|---|---|
| 3,723,988 | 3/1973 | Kardashian | 340/258 R |
| 3,750,127 | 7/1973 | Ayers et al. | 340/38 R |
| 3,754,223 | 8/1973 | Shtrikman | 340/38 L |
| 3,801,976 | 4/1974 | Ross et al. | 340/258 R |
| 3,825,889 | 7/1974 | Koerner | 340/38 L |
| 3,832,704 | 8/1974 | Kardashian | 340/258 R |

*Primary Examiner*—Glen R. Swann, III
*Attorney, Agent, or Firm*—Nathan Edelberg

[57] ABSTRACT

The disclosed invention pertains to an intruder detection system incorporating paired sensors with minimum sensor balance restraints. The sensor requires as few as three generally parallel trenches and an end trench and thus is suitable for installation by unskilled personnel in a relatively short time period. The sensor of this invention may provide up to three intrusion alarms indicative of a magnetic disturbance alone, or of a combined magnetic and strain disturbance.

4 Claims, 3 Drawing Figures

LINE INTEGRATED COMBINATION MAGNETIC AND STRAIN LINE SENSOR

STATEMENT OF GOVERNMENT INTEREST

The invention described herein may be manufactured, used, and licensed by or for the Government for Governmental purposes without the payment to me of any royalties thereon.

BACKGROUND OF THE INVENTION

This invention relates to line sensors; and more particularly to a line integrated combination magnetic and strain line sensor.

There are many instances where one wishes to protect a given area against intrusion by a person or by an object such as a vehicle or the like. Many different types of alarm systems and detectors exist for protecting a given area. One such system is a line sensor. Line sensors are buried in the ground of the area to be protected and respond to any intrusion into the area. Both strain responsive and magnetic responsive line sensors are utilized.

The prior-art strain sensors commonly use a coaxial cable (strain cables) responsive to soil transmitted strain. The response between the center conductor and outer braid of the cable results in an analog signal, generated on the inner conductor, which can be processed electronically to actuate an alarm.

Prior art magnetic sensors commonly utilize a buried passive magnetic loop. Such loops are generally 300 meters long, coplanar with the earth's surface and are transposed at intervals. The transpositions are provided to nullify geomagnetic perturbations which can induce nuisance alarms. While such magnetic sensors have proved effective, they have inherent deficiencies which can limit their effectiveness. For example, if there is any unbalance in opposing loop areas, a net noise "Capture" area exists and this results in system vulnerability to nuisance alarming caused by lightning and other sources of geomagnetic noise. In order to minimize such false alarming, precise loop balance is required and such loop balancing can be accomplished only by trained personnel. Further, due to the required transpositions, these prior art loops are not readily buried in the ground since they require a multitude of cross trenches at five feet intervals.

This invention provides a combination magnetic and strain line sensor that is readily installed and operated by relatively unskilled personnel and is not as vulnerable to nuisance alarming caused by lightning or other geomagnetic noise as the prior transposed magnetic loop systems.

SUMMARY OF THE INVENTION

The combination magnetic and strain line sensor of this invention comprises two coaxial cable loops and processing electronic circuitry. Three parallel trenches are dug and the loops are placed in the trenches such that one leg of each loop occupies the middle trench. Magnetic sensing and processing circuitry is provided to actuate a magnetic pick-up alarm and strain sensing and processing circuitry is provided to actuate a pressure alarm. In addition, circuitry is provided to actuate a combined strain and magnetic alarm. The braid of the coaxial cable used to make up the loops provides magnetic sensing and the center conductor of the cables provides strain sensing.

BRIEF DESCRITION OF THE DRAWING

The exact nature and structural details of the invention will become apparent from the following detailed description when read in conjunction with the annexed drawing in which.

DETAILED DESCRIPTION OF THE INVENTION

Figure 1:
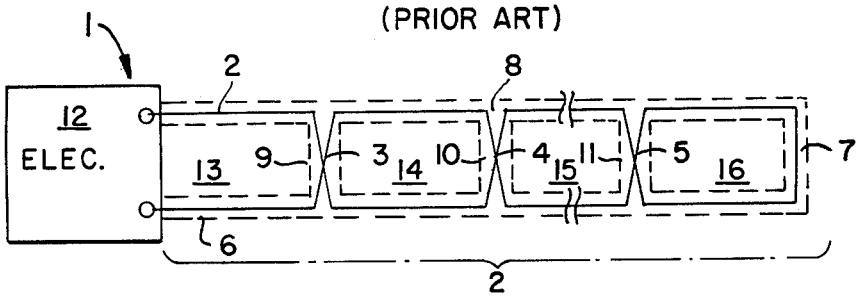
FIG. 1. (PRIOR ART)
FIG. 1 shows a prior magnetic line sensor system.

Referring to FIG. 1, this Figure shows a typical layout of a prior art magnetic line sensor. The magnetic line sensor 1 of FIG. 1 includes a passive magnetic loop 2 that has the three transpositions or cross-overs 3, 4 and 5, forming subloops 13, 14, 15 and 16. The trenches 6, 7 and 8 accomodate the outer perimeter of loop 2 and the trenches 9, 10 and 11 accomodate transpositions 3, 4 and 5 respectively. After the trenches are dug and loop 2 is placed in the trenches, these trenches are covered over to conceal loop 2. The open end of loop 2 is coupled to the processing electronic circuitry 12.

If any object containing magnetic material or any person carrying an object or objects containing magnetic material passes over any subloop of loop 2, loop 2 senses the magnetic disturbance caused by such objects and electronic circuitry 12 will produce a signal or alarm indicating that an intrusion has occurred in the area of loop 2.

Magnetic line sensors such as sensor 1 of FIG. 1 provide effective magnetic sensing; however such devices have inherent deficiencies. Subloop pairs 13 and 14 and 15 and 16 delineate opposing subloop areas which serve to nullify geomagnetic perturbances. However, if any unbalance exists in these opposing subloop areas, a net noise "capture" area exists, and this results in vulnerability to nuisance alarming caused by lightning or other geomagnetic noise. Thus, the opposing subloop must be perfectly balanced to prevent such nuisance alarming. Loop balance is a precise operation requiring trained and skilled personnel. However, even with trained personnel, precise subloop balance is difficult, if not impossible, to obtain in the field. Even under laboratory conditions, perfect subloop balance is difficult to obtain. Thus, even if carefully installed and balanced, the chances are great that some unbalance will be present in the opposing subloop formed by the transpositions 3, 4 and 5 and a net noise capture area will exist in loop 2, thereby rendering loop 2 susceptible to nuisance alarming.

Figure 2:
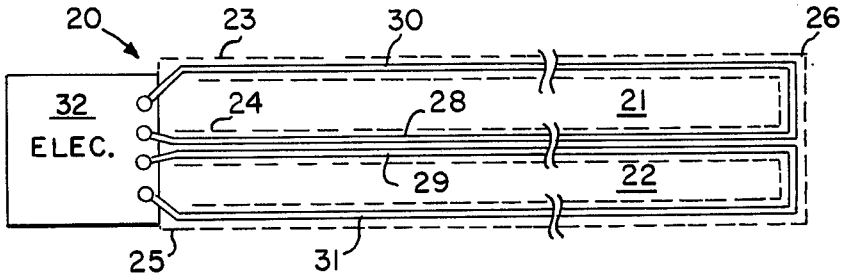
FIG. 2 shows a preferred embodiment of this invention.

FIG. 2 shows a preferred embodiment of this invention which overcomes the problems of transducer 2 of FIG. 1 and provides both magnetic and strain sensing. As shown in FIG. 2, transducer 20 includes the two loops 21 and 22. Loops 21 and 22 are formed from coaxial cable having a braid and an inner conductor.

The three parallel trenches 23, 24 and 25 and the short end trench 26 are provided to accomodate loop 21 and 22. After trenches 23, 24, 25, and 26 are dug, loops 21 and 22 are placed in these trenches such that leg 28 of loop 21 and leg 29 of loop 22 are placed parallel in trench 24 with leg 30 of loop 21 placed in trench 23, leg 31 of loop 22 placed in trench 25 and the short or closed ends of loops 21 and 22 placed in trench 26. These trenches are, of course, then filled with dirt to conceal loops 21 and 22. The open end of loop 21 and the open end of loop 22 are both coupled to the electronic circuitry 32. Electronic circuitry 32 is utilized to process any signals from loops 21 and 22 and provide an alarm or indication that an intrusion has occured.

Loops 21 and 22 are generally up to 300 meters long and are generally equal in area but need not be precisely equal in area. Only a casual attempt is made to balance loops 21 and 22 since any disparity can be compensated by automatic gain control circuitry in electronic circuitry 32. Referring back to sensor 1 of FIG. 1, it is also obvious that loops 21 and 22 do not contain the transpositions of loop 2 of sensor 1. Thus, the inherent balancing problems encountered with loop 2 of sensor 1 and the noise "capture" problems of loop 2 are not present in loops 21 and 22 of sensor 20 of FIG. 2.

As mentioned above, sensor 21 is both a magnetic and a strain sensor. The braid of the coaxial cables used to form loops 21 and 22 provide magnetic pick-up and the inner conductor provides the strain sensing. By providing for magnetic and strain sensing, sensor 21 can operate in any one of three modes, strain sensing only mode, magnetic sensing only mode and combined strain and magnetic sensing mode. The strain only mode of operation will occur if a magnetically clean intruder, who may be carrying plastic explosives for example, attempts to penetrate the area being monitored by sensor 20. As this person crosses loops 21 and 22, a force or strain transmitted by the ground will be applied to loops 21 and 22 and an analog signal will be generated. No magnetic sensing will take place since plastic explosives are magnetically clean and the intruder was assumed to be magnetically clean. The analog signal will be processed by electronic circuitry 32, and by providing appropriate circuitry, a strain only indication or alarm is generated by electronic circuitry 32.

The magnetic sensing only mode can occur if, for example, the ground covering and surrounding loops 21 and 22 are heavily frozen. If the ground is frozen, the ground may not transmit the pressure to loops 21 and 22. If this is the case, only the magnetic disturbance created by the intruder will be picked up by loops 21 and 22. The signal caused by this magnetic disturbance will be processed by electronic circuitry 32 and if appropriate circuitry is provided, a magnetic only indication or alarm, distinct from the strain only alarm, is generated. Of course, if magnetic sensing only can be obtained because of frozen ground, the intruder cannot be magnetically clean or no alarm will occur. This is not a serious problem since, magnetic sensing only will rarely occur.

The most common mode of operation of sensor 20 will be the combined magnetic and strain mode. In this mode both a strain signal and a magnetic signal are generated in response to an intrusion in the area protected by loops 21 and 22 and both these signals are processed by electronic circuitry 32 to produce a combination alarm or indication. The combination alarm may be distinct from the magnetic only alarm and the strain only alarm if appropriate processing circuitry is provided. Of course only a single alarm or indication need be provided for all three modes of operation. However, with only a single alarm or indication, one cannot determine the mode of operation of sensor 20.

Figure 3:
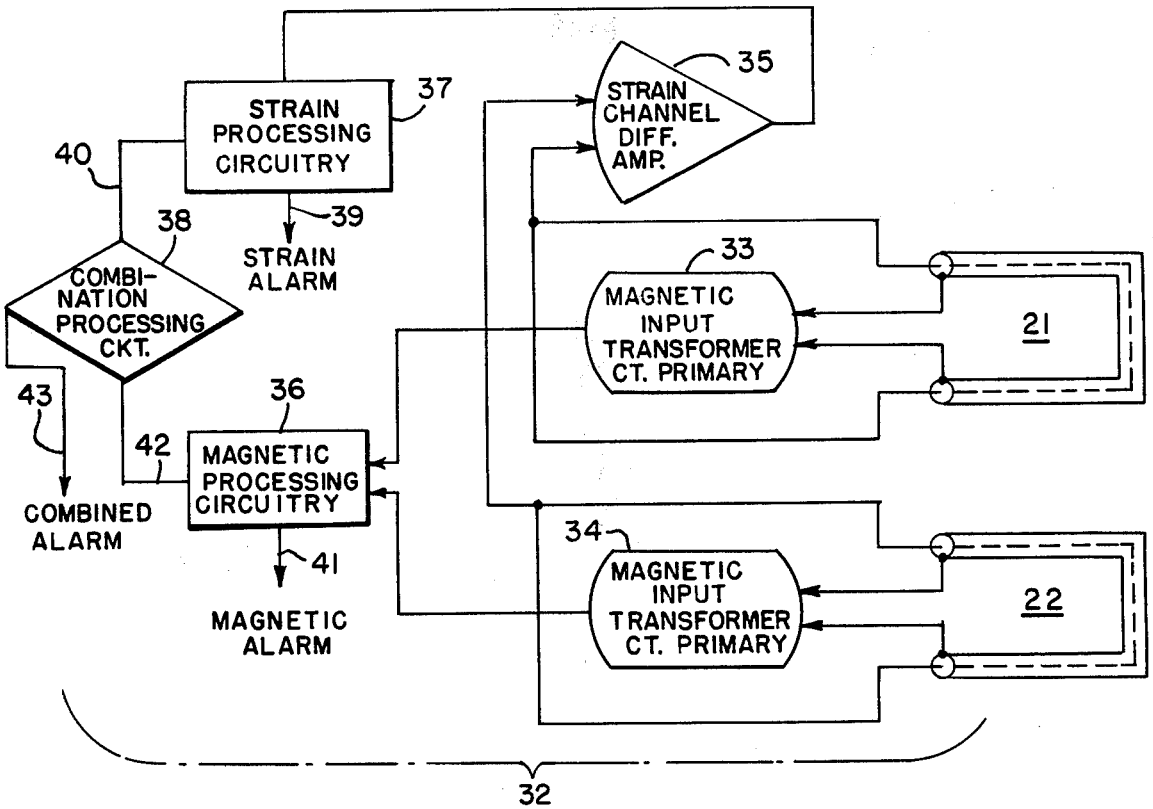
FIG. 3 shows in block diagram form circuitry that may be utilized with the preferred embodiment of FIG. 2.

FIG. 3 shows, in block diagram form, circuit blocks that may be utilized to fabricate electronic circuitry 32 of FIG. 2 to provide three distinct alarms that distinguish the three modes of operation. Referring to FIG. 3, the braid of the coaxial cable of loop 21 is coupled to the magnetic input transformer 33 and the braid of the coaxial cable of loop 22 is coupled to the magnetic input transformer 34. The center conductor of loop 21 and the center conductor of loop 22 are coupled to separate inputs of the strain channel differential amplifier 35. The output of strain channel differential amplifier 35 is coupled to the input of strain processing circuitry 37. Strain processing circuitry 37 is any suitable circuitry that processes the output of differential amplifier 35 to provide the desired output. For example, in FIG. 3, the output lead 39 is shown as going to a strain alarm. The strain alarm may be an audio alarm such as a bell, siren or the like or may be a visual indicator such as a light or meter. Thus, processing circuitry 37 need merely provide an output on lead 39 in response to an input from differential amplifier 35 that will actuate the alarm device utilized. Differential amplifier 35 and processing circuitry 37 provide an output on lead 39 to actuate an alarm that indicates that only a strain response has been obtained from loops 21 and 22, thus indicating that sensor 20 is operating in the strain only mode.

Magnetic input transformer 33 is coupled to one input of the magnetic processing circuitry 36 and the output of magnetic input transformer 34 is coupled to the other input of magnetic processing circuitry 36. In response to an input from magnetic input transformer 33 and magnetic input transformer 34, processing circuitry 36 provides an output signal on the lead 41 which is shown as going to a magnetic alarm. As is the case with the strain alarm, the magnetic alarm can be an audio alarm or a visual alarm and processing circuitry 36 need merely provide a signal on lead 41 that will actuate the alarm utilized. Input transformers 33 and 34 and processing circuitry 36 provide a signal on lead 41 to indicate that only a magnetic response has been received from loops 21 and 22 and that therefore sensor 20 is operating in the magnetic only mode.

Strain processing circuitry 37 has a second output lead, the lead 40, and magnetic processing circuitry 36 also has a second output lead, the lead 42. Output lead 40 of strain processing circuitry 37 is coupled to one input of the combination processing circuitry 38 and output lead 42 of magnetic processing circuitry 36 is coupled to the other input of combined processing circuitry 38. In response to a signal from both strain processing circuitry 37 and magnetic processing circuitry 36, combined processing circuitry 38 provides an output signal on lead 43 which is shown as going to a combined alarm. The combined alarm may, for example, be an audio or visual alarm and combined processing circuitry 38 need merely provide a signal on lead 43 that will actuate the alarm utilized. When such a signal appears on line 43, sensor 20 is operating in the combined magnetic and strain mode.

The circuitry of FIG. 3 is shown in block diagram form since all the circuits utilized are well known circuits and in fact various different known circuits could be utilized to achieve the desired results. As shown in FIG. 3, the circuitry does provide for distinct indications of the three modes of operation of sensors 20. That is, an output will appear only on lead 39 in the strain mode, only on lead 41 in the magnetic mode and no output appears on lead 43 unless sensor 20 is operating in the combined mode. In the combined mode of operation, a signal would also normally appear on lead 39 and on lead 41 and therefore all three alarms would be actuated unless the signals on leads 39 and 41 are inhibited. Whether all three alarms operate in the combined mode or only the combined alarm operates is really a matter of choice since all three alarms being actuated would provide a distinct combined alarm indication. If only the combined alarm is to be actuated, the signals that would appear on leads 39 and 41 could be inhibited or the associated alarms could be inhibited during combined operation in any well known manner. Further, only one alarm need be provided if one does not wish to distinguish between modes of operation or combined processing circuit 38 could be eliminated since actuation of both the strain alarm and magnetic alarm would provide an indication of the combined mode of operation. These variations of the circuitry of FIG. 3 are mentioned to illustrate that the circuitry of FIG. 3 is given by way of example and that various modifications can be made to this circuitry and that other well known circuitry can be utilized.

In addition to providing only an indication that an intrusion has taken place in areas protected by sensor 20 and in which of three modes sensor 20 is operating, more sophisticated but known circuitry could be provided in electronic circuitry 32 to obtain additional information. Tests of sensor 20 have shown that the loops 21 and 22 provide signals having well defined waveshapes. Further, these well defined waveshapes are different for different intruders. That is, a person walking in the protected area produces a given waveshape that is different from the waveshape produced by a vehicle and a wheeled vehicle may produce a waveshape that is different than the waveshape produced by a tracked vehicle such as a tank. The waveshape of an intruder is called the signature of that intruder. Thus, by utilizing known wave analyzing and logic circuitry, it is possible to distinguish between various different types of intrusion. Of course, the signatures of various intruders must be significantly different to be able to distinguish between different types of intrusion. For example, the difference between the signature of a person and the signature of a heavy truck will be significantly different but the difference between the signature of a truck, even a heavy truck, and the signature of an automobile may not be sufficiently different to provide, even with complex circuitry, an output that will distinguish between an automobile and a truck.

While the invention has been described with reference to a specific embodiment, it will be obvious to those skilled in the art that various changes and modifications, other than those specifically mentioned, can be made to the embodiment shown and described without departing from the spirit and scope of the invention as set forth in the claims.

What is claimed is:

1. A line integrated combination magnetic and strain line sensor for indicating an intrusion into the area being monitored by said sensor comprising:

first and second U shaped sensors, each of said sensors having two elongated leg sections and a bottom section with said leg sections of each sensor disposed in substantially the same plane, said sensors being juxtaposed such that one leg section of said first sensor is disposed in close proximity to one leg section of said second sensor, each of said first and second sensors consisting of a coaxial cable with center and outer conductors and a selected dielectric therebetween, each of said sensors being electrically open ended at both ends;

first and second inductive coupling means each including input means and output means, each of said input means of said first and second coupling means electrically connected across the outer conductors of the ends of its respective coaxial sensor such that any current flow in the outer conductor loop formed by such electrical connection is inductively coupled to its respective output means as an electrical output signal representative of a respective earth's magnetic field relation disturbance;

first signal comparator means having first and second inputs thereof electrically connected to said output means of said first and second inductive coupling means, respectively, and adapted to produce an output signal in response to input signal differences;

first and second electrical shunt means electrically connected across the inner conductors of the ends of its respective coaxial sensor such that said inner conductors of said first and second sensors form first and second loop sections adapted to produce an electrical signal representative of ambient strain disturbances;

second signal comparator means having first and second inputs thereof electrically connected to said first and second loop sections, respectively, and adapted to produce and output signal in response to input signal differences; and alarm means electrically connected to said first and second signal comparator means and adapted to provide an area intrusion alarm in response to an output signal from at least one of said first and second signal comparator means.

2. The line integrated combination magnetic and strain line sensor as defined in claim 1 wherein said first and second coaxial sensors are buried below the earth's surface in three substantially parallel trenches and a relatively short end trench perpendicular thereto such that the center trench of said three substantially parallel trenches contains both said first and second coaxial sensors.

3. The line integrated combination magnetic and strain line sensor as defined in claim 2 wherein said first and second U shaped sensors generally encompass substantially similar areas and said leg sections thereof are each approximately 300 meters long.

4. The line integrated combination magnetic and strain line sensor as defined in claim 2 wherein said alarm means is adapted to provide three distinctive alarms representative of an intruder strain disturbance, of an intruder magnetic disturbance, and of an intruder strain and magnetic disturbance, as actually sensed by said first and second sensor means.

* * * * *